US010403103B1

(12) United States Patent
Kugler et al.

(10) Patent No.: US 10,403,103 B1
(45) Date of Patent: Sep. 3, 2019

(54) APPARATUS AND METHOD FOR TAMPER DETECTION OF A MOUNTED DEVICE

(71) Applicant: BlackBerry Limited, Waterloo (CA)

(72) Inventors: Andrew Kugler, Ottawa (CA); Ryan Michael Parker, Ottawa (CA); Edward Snow Willis, Ottawa (CA)

(73) Assignee: BlackBerry Limited, Waterloo (CA)

( * ) Notice: Subject to any disclaimer, the term of this patent is extended or adjusted under 35 U.S.C. 154(b) by 0 days.

(21) Appl. No.: 15/973,361

(22) Filed: May 7, 2018

(51) Int. Cl.
*G08B 13/08* (2006.01)

(52) U.S. Cl.
CPC ..... *G08B 13/08* (2013.01)

(58) Field of Classification Search
CPC combination set(s) only.
See application file for complete search history.

(56) References Cited

U.S. PATENT DOCUMENTS

| | | | | |
|---|---|---|---|---|
| 6,720,874 | B2 * | 4/2004 | Fufido | G07C 9/00031 340/5.2 |
| 6,724,316 | B2 | 4/2004 | Addy et al. | |
| 9,189,933 | B1 * | 11/2015 | Stevens | G08B 13/08 |
| 2002/0067259 | A1 * | 6/2002 | Fufidio | G07C 9/00031 340/541 |
| 2011/0254665 | A1 * | 10/2011 | Lindsay | G06K 19/0717 340/10.5 |
| 2017/0138979 | A1 * | 5/2017 | Prunet | G01C 21/08 |

* cited by examiner

*Primary Examiner* — Travis R Hunnings
(74) *Attorney, Agent, or Firm* — Borden Ladner Gervais LLP; Todd Keeler

(57) ABSTRACT

A method and apparatus for determining tampering at a device coupled to a moveable object includes receiving a plurality of orientation states of the device, the plurality of orientation states measured by an orientation sensor, determining, based on the received orientation states, at least two expected orientation states, receiving a further orientation state of the device measured by the orientation sensor, in response to determining that the further orientation state differs from the at least two expected orientation states, generating a tamper alert.

19 Claims, 4 Drawing Sheets

APPARATUS AND METHOD FOR TAMPER DETECTION OF A MOUNTED DEVICE

FIELD

The present disclosure relates to tamper detection of a mounted device.

BACKGROUND

Networks of wireless devices, or wireless nodes, have become more prevalent with the growth of the so called internet of things (IOT). Because the nodes may be located in accessible locations, nodes may be susceptible to tampering by, for example, vandalism or by being inadvertently dislodged. Tampering of devices may be determined based on movement of the device. In some cases, a node may be located on a moveable object, such as a door, which presents difficulty in determining when movement of the device constitutes tampering.

Improvements in tamper detection is desired.

BRIEF DESCRIPTION OF THE DRAWINGS

Embodiments of the present disclosure will now be described, by way of example only, with reference to the attached Figures.

DETAILED DESCRIPTION

Figure 1:
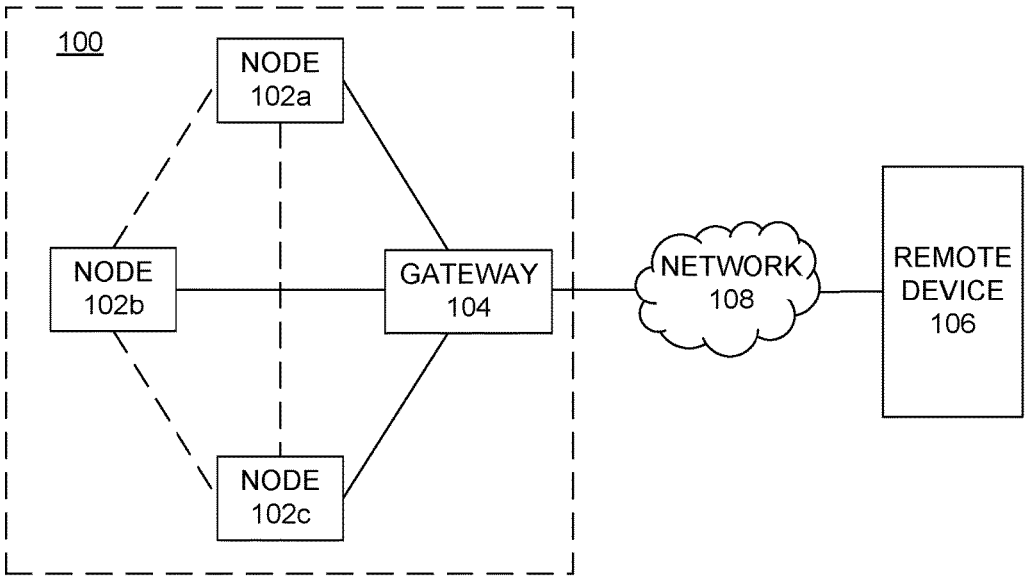
FIG. 1 is a block diagram of an example wireless node network in accordance with the present disclosure.

The present disclosure provides an apparatus and method for determining tampering at a device that is coupled, or mounted, to a moveable object such as, for example, a roll-up door. According to the present disclosure, an open orientation state and a closed orientation state of the device are determined. The open and closed orientation states correspond to the orientation of the device when the movable object is in an open position and a closed position, respectively. The open and closed orientations states are determined based on a plurality of measured orientation states. Once the open and closed orientation states are determined, a tamper alert may be generated when subsequently measured orientation state differs from, or is other than, the open and closed orientation states.

In an embodiment, the present disclosure provides a method for determining tampering at a device coupled to a moveable object that includes receiving a plurality of orientation states of the device, the plurality of orientation states measured by an orientation sensor, determining, based on the received orientation states, at least two expected orientation states, receiving a further orientation state of the device measured by the orientation sensor, in response to determining that the further orientation state differs from the at least two expected orientation states, generating a tamper alert.

In an example embodiment, the moveable object is a roll-up door, and the at least two expected orientation states are a door-open orientation state and a door-closed orientation state corresponding to an open position and a closed position, respectively, of the roll-up door.

In an example embodiment, the moveable object is a crane arm, and the at least two expected orientation states are a lowered orientation state and an extended orientation state corresponding to a lower position and an extended position, respectively, of the crane arm.

In an example embodiment, determining the at least two expected orientation states comprises determining the at least two most common orientation states from the received plurality of orientation states.

In an example embodiment, determining the at least two expected orientation states further comprises determining that each of the at least two most common orientation states meets a threshold number.

In an example embodiment, determining the at least two expected orientation states is performed in response to the number of the received plurality of orientation states being at least a predetermined number.

In an example embodiment, the received plurality of orientation states are generated during a calibration process in which the orientation sensor measures, at least, a first expected orientation state when the moveable objection is in a first expected position and a second expected orientation state when the moveable object is in a second expected position, and wherein determining the at least two expected orientation states comprise setting the at least first expected orientation state and the second expected orientation state as the at least two expected orientation states.

In an example embodiment, the orientation state of the device is received in response to movement of the movable object.

In an example embodiment, movement of the moveable object is movement that meets a threshold amount.

In another embodiment, the present disclosure provides an apparatus for determining tampering at a device coupled to a moveable object includes a processor in communication with an orientation sensor of the device, the processor configured to receive a plurality of orientation states of the device, the plurality of orientation states measured by an orientation sensor, determine, based on the received orientation states, at least two expected orientation states, receive a further orientation state of the device measured by the orientation sensor, in response to determining that the further orientation state differs from the at least two expected orientation states, generate a tamper alert.

In an example embodiment, the device is coupled to a door, and the at least two expected orientation states are a door-open orientation state and a door-closed orientation state corresponding to an open position and a closed position, respectively, of the roll-up door.

In an example embodiment, the moveable object is a crane arm, and the at least two expected orientation states are a lowered orientation state and an extended orientation state corresponding to a lower position and an extended position, respectively, of the crane arm.

In an example embodiment, the processor is configured to determine at least two expected orientation states by determining the at least two most common orientation states from the received plurality of orientation states.

In an example embodiment, the processor is configured to determine at least two expected orientation states when each of the two most common orientation states meets a threshold number.

In an example embodiment, the processor is configured to determine at least two expected orientation states in response to the number of the received plurality of orientation states being at least a predetermined number of orientation states.

In an example embodiment, the received plurality of orientation states are generated during a calibration process in which the orientation sensor measures, at least, a first expected orientation state when the moveable objection is in a first expected position and a second expected orientation state when the moveable object is in a second expected position, and wherein determining the at least two expected orientation states comprise setting the at least first expected orientation state and the second expected orientation state as the at least two expected orientation states.

In an example embodiment, the orientation state of the device is received in response to movement of the moveable object.

In an example embodiment, movement of the moveable object is movement that meets a threshold amount.

In an example embodiment, wherein the apparatus is a server in communication with the device.

For simplicity and clarity of illustration, reference numerals may be repeated among the figures to indicate corresponding or analogous elements. Numerous details are set forth to provide an understanding of the embodiments described herein. The embodiments may be practiced without these details. In other instances, well-known methods, procedures, and components have not been described in detail to avoid obscuring the embodiments described.

FIG. 1 is a schematic diagram of an example wireless node network 100. The example wireless node network 100 includes a number of nodes 102*a* to 102*c* and a gateway 104. Each node 102*a* to 102*c* may establish wireless connections with the gateway 104, as indicated by the solid lines, to facilitate transmitting data to and receiving data from the gateway 104.

Additionally, or alternatively, each node 102*a* to 102*c* may establish wireless connections with one or more of the other nodes 102*a* to 102*c* of the wireless node network 100, as indicated by the dashed lines, to facilitate transmitting data to and receiving data from the other nodes 102*a* to 102*c*, forming what is known as a meshed network. In this example, a node 102*a* to 102*c* may communicate with the gateway 104 via one or more other nodes 102*a* to 102*c* which act as an intermediary, rather than the node 102*a* to 102*c* transmitting data to the gateway 104 directly. For example, node 102*a* may transmit data to the gateway 104 by first transmitting the data to the node 102*b*, which node then transmits that data onto to the gateway 104. Similarly, in this example, the gateway 104 may transmit data to the node 102*a* by first transmitting that data to the node 102*b*, which node then transmits the data onto the node 102*a*.

Although the example wireless node network 100 shown in FIG. 1 includes three nodes 102*a* to 102*c* and one gateway 104, the network 100 may include a greater or a fewer number of nodes 102*a* to 102*c* and more than one gateway 104.

The nodes 102*a* to 102*c* and the gateway 104 may utilize any suitable wireless communication protocol to transmit and receive data with each other. For example, the nodes 102*a* to 102*c* and the gateway 104 may utilize a short-range wireless communication protocol such as, for example, Bluetooth®, IEEE 802.15.4, WFi®, or Zigbee®. In another example, nodes 102*a* to 102*c* and the gateway 104 may utilize other suitable radio technologies based on, for example, CDMA2000, 3GPP GERAN, 3GPP UTRAN, 3GPP E-UTRAN (LTE) or 3GPP 5G. The nodes 102*a* to 102*c* and the gateway 104 may communicate with each other utilizing network-to-device radio links or device-to-device radio links such as 3GPP Proximity-based services (ProSe) making use of a PC5 interface, or a combination of network-to-device and device-to-device radio links.

The gateway 104 may transmit data received from the nodes 102*a* to 102*c* to, for example, a remote device 106. The remote device 106 may be, for example, a server or any other electronic device. Examples of electronic devices include mobile, or handheld, wireless communication devices such as cellular phones, cellular smart-phones, wireless organizers, personal digital assistants, computers, tablet computers, mobile internet devices, electronic navigation devices, and so forth.

The gateway 104 may transmit data to the remote device 106 via a network 108. The network 108 may be any suitable wired or wireless network, or combination of wired and wireless networks including, for example, a local area network (LAN), or a wide area network (WAN), or a combination thereof. Wireless communication between the gateway 104 and the network 108 may utilize any suitable short-range wireless communication protocol, as described above, or any utilize any suitable cellular communication protocol including, for example, CDMA2000, 3GPP GERAN, 3GPP UTRAN, 3GPP E-UTRAN (LTE) or 3GPP 5G.

The gateway 104 may be, for example, functionally similar to the other nodes 102*a* to 102*c* of the wireless node network but with the additional functionality of transmitting data collected from the nodes 102*a* to 102*c* to the remote device 106 via the network 108, and to transmit data received from the remote device 106 to the nodes 102*a* to 102*c*.

The nodes 102*a* to 102*c* may be any type of wireless device that is suitable for transmitting data to and receiving data from other the nodes 102*a* to 102*c* and the gateway 104 of the wireless node network 100. In an example, one or more of the nodes 102*a* to 102*c* may include, for example, sensors that are utilized to collect data. The data collected from sensors at the nodes 102*a* to 102*c* may then be transmitted to the gateway 104 such that the wireless node network 100 forms a sensor network. The sensors included in the nodes 102*a* to 102*c* may be any suitable sensors. Suitable sensors may include, for example, one or more of a temperature sensor, an accelerometer, a light sensor, a sound sensor, a pressure sensor, a gas sensor, a pressure sensor such as, for example, a tire pressure monitoring sensor (TPMS), a motion sensor, a velocity sensor, a radio frequency identity (RFID) reader, a location sensor utilizing, for example, a global positioning system (GPS), and so forth. The type of sensor(s) included in the nodes 102*a* to 102*c* may depend on, for example, the specific application in which the wireless node network 100 is utilized. In some examples, the different nodes 102*a* to 102*c* of the wireless node network 100 may include different sensors.

In an example, the nodes 102*a* to 102*c* may include sensors that are utilized to collect data, which may be transmitted by the gateway 104 to a remote device 106, such as a server, via a network 108. In an example, the nodes 102*a* to 102*c* may monitor an environment within a vehicle such as, for example, a transport trailer or a shipping container. The nodes 102*a* to 102*c* may be installed within the vehicle to take measurements of the environment within the vehicle. The gateway 104 may be installed, for example, on an external surface of the transport trailer or shipping container in order to reduce interference due to the walls of the transport trailer or shipping container to improve communication with the remote device 106.

Figure 2A:
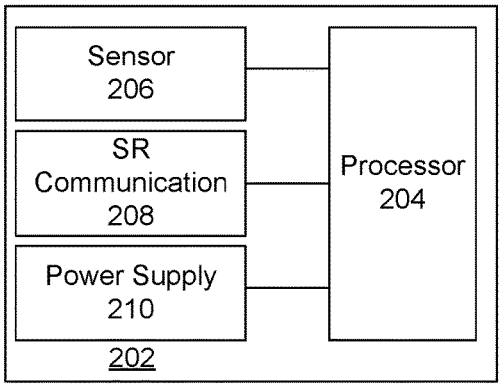
FIG. 2A is a block diagram of an node of a wireless node network in accordance with the present disclosure.
Figure 2B:
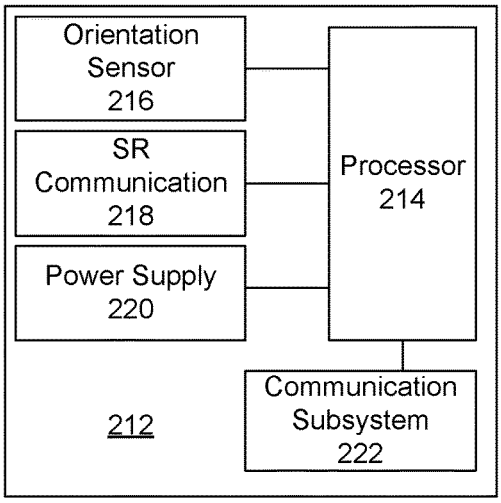
FIG. 2B is a block diagram of an example gateway of a wireless node network in accordance with the present disclosure.

FIGS. 2A and 2B are schematic diagrams of an example node 202 and an example gateway 212, respectively, that may be utilized as the nodes 102*a* to 102*c* and the gateway 104 of the wireless node network shown in FIG. 1 for forming a wireless sensor network.

The node 202 includes multiple components, such as a processor 204 that controls the overall operation of the node 202. The node 202 may include sensing functionality performed by a sensor 206. The sensor 206 may include, for example, one or more of a temperature sensor, an accelerometer, a light sensor, a sound sensor, a pressure sensor, a gas sensor, a pressure sensor such as a TPMS, a motion sensor, a velocity sensor, an RFID reader, a location sensor, and so forth. In an example, short-range (SR) communication functionality, including receiving and transmitting data with other nodes, or a gateway, or both, is performed by a SR communication subsystem 208. A power source 210, such as one or more rechargeable batteries or a port to an external power supply, powers the node 202.

Similarly, the gateway 212 includes multiple components, such as a processor 214 that controls the overall operation of the gateway 212. SR communication functionality, including receiving data from and transmitting data to nodes, or another gateway, or both, is performed by a SR communication subsystem 218. A power source 220, such as one or more rechargeable batteries or a port to an external power supply, powers the gateway 212. A communication subsystem 222 is utilized to transmit data to, and receive data from, a remote device, such as for example the remote device 106 described above, via a network, such as for example the network 108 described above.

As described above, the gateway 212 may be installed on an external surface of a vehicle, transport trailer, or shipping container. Because the gateway 212 is installed on an external surface, it may be desirable to detect if the gateway 212 has been tampered with. In order to facilitate tamper detection, the gateway 212 includes an orientation sensor 216. Any suitable type of orientation sensor may be utilized to provide the orientation sensor 216 included in the gateway 212. In an example, the orientation sensor 216 may include one or more of an accelerometer, a gyroscope, or a magnetometer, which are utilized to determine changes in the orientation of the gateway 212.

The orientation sensor 216 outputs the measured orientation as an orientation state. In a simple example, the orientation sensor 216 may be thought of as a six-sided cube, with each side of the cube representing a different orientation state. For example, each side of the cube may be associated with a number from one through six. In this example, the orientation state output by the orientation sensor 216 may be number, one through six, that is associated with the side of the cube that is facing a particular direction, such as the direction of the gravitational force. In practice, the orientation sensor 216 may be configured to differentiate between more or less than six orientation states. For example, the orientation sensor 216 may be calibrated to measure a change in orientation state when the gateway 212 is rotated by 45° in any of the pitch, roll, or yaw axes.

Orientation sensor 216 may measure the orientation state of the gateway 212 periodically, or may measure the orientation state in response to an event. For example, the orientation sensor 216 may measure the orientation state of the gateway 212 in response to detecting motion of the gateway 212 that meets or exceeds a threshold. For example, the threshold may be a threshold rotation angle such that rotation of the device by at least the threshold rotation angle will trigger the orientation sensor 216 to measure the orientation state. In an example, the threshold rotation angle may correspond to the angle between orientation states such that a measurement of the orientation state is made each time rotation of the orientation sensor 212 leads to a change in the orientation state.

In another example, the orientation sensor 212 may measure the orientation state in response to movement of the moveable object to which the gateway 212 is coupled or mounted. For example, if the gateway 212 is mounted to a door, the event that triggers an orientation measurement by the orientation sensor 216 may be the door moving from a closed to an open position, or vice versa. The movement of the moveable object may be determined by, for example, an accelerometer or by any other suitable sensor of the gateway 212 or any suitable sensor (not shown) external to and communication with the gateway 212 that may determine movement of the movable object. The measured orientation state may be transmitted to a remote device, such as remote device 106 in the example shown in FIG. 1, via the communication subsystem 222.

Although the present disclosure describes detection tampering utilizing an orientation sensor 216 of the gateway 212, detection tampering of the present disclosure may be applied to any device that includes an orientation sensor. For example, any of the nodes 102*a* to 102*c* and 202 may include an orientation sensor similar to orientation sensor 216 that may be utilized for performing tamper detection for the nodes 102*a* to 102*c* and 202.

The gateway 212 may also include additional sensors (not shown) such as, for example, one or more of a temperature sensor, an accelerometer, a light sensor, a sound sensor, a pressure sensor, a gas sensor, a pressure sensor such as a TPMS, a motion sensor, a velocity sensor, an RFID reader, a location sensor, and so forth.

Detecting tampering on a device that remains stationary, such as a device installed on a wall of building, for example, may include simply detecting tampering any time any movement or change in orientation of the device is detected. A challenge for detecting tampering on a device, such as the gateway 212, when the device is installed on moveable object such as, for example, a door of a transport trailer or shipping container, is that the orientation of the device changes regularly when the door is moved between a closed position and an open position, and vice versa.

In the case in which the door on which a device is installed is a barn-type door that swings open and closed on hinges along a vertical edge, tamper detection may be relatively simple. In this example, all rotational motion of the device due to the door barn-type door opening and closing, and movement of the transport trailer due to, for example, turning corners while travelling, is expected to be substantially confined to rotations about the vertical axis. Thus, in the case of a device mounted to a barn-type door, tampering may be determined whenever the device is determined to rotate of the device about a horizontal axis, e.g., an axis that is substantially perpendicular the gravitational force.

Figure 3A:
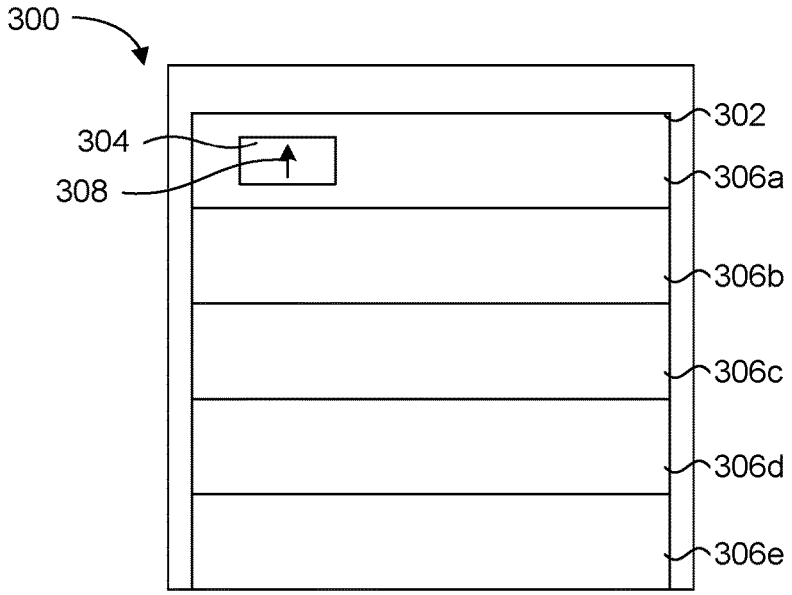
FIG. 3A is an elevation view of an orientation sensing device attached to a door of a transport trailer in accordance with the present disclosure.
Figure 3B:
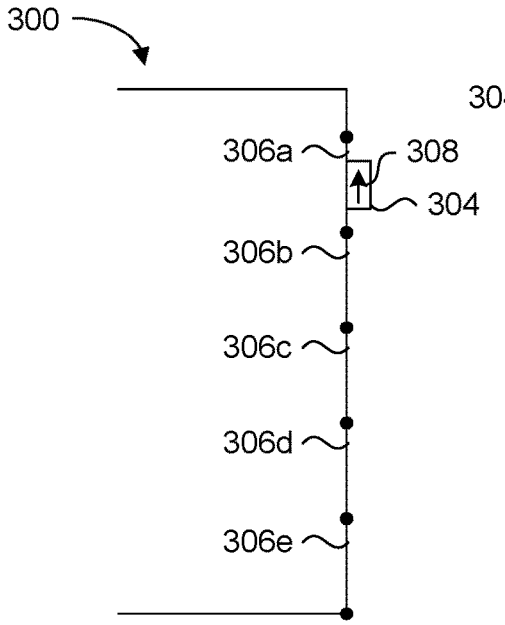
FIGS. 3B and 3C are cross-section views of an orientation sensing device attached to the door of a transport trailer as shown in FIG. 3A with the door in a closed position and open position, respectively.
Figure 3C:
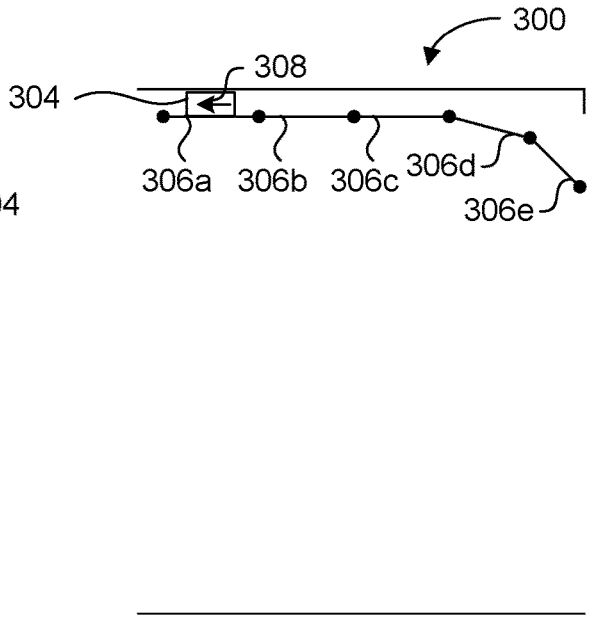

In the example shown in FIG. 3A through FIG. 3C, the device 304 is mounted to a roll-up type door 302 of a transport trailer 300. Determining tampering in the device 304 mounted to a roll-up door 302 is more complex than, for example, a device mounted to a wall or to a barn-type door as described above, because in addition to rotations about a vertical axis due to the vehicle turning, the device 304 will rotate about a horizontal axis when the door 302 is opened and closed, as seen in FIGS. 3B and 3C.

Referring to FIG. 3A, a rear view of a transport trailer 300 is shown. The transport trailer 300 includes a door 302 on which an orientation sensing device 304 is mounted. The device 304 may be, for example, a gateway 104 or a node 102*a* to 102*c* of a wireless node network 100 installed in the transport trailer 300. The device may include an orientation sensor (not shown) similar to orientation sensor 216 described previously. For illustrative purposes, the device 304 is shown with an internal reference axis, represented by the arrow 308.

The roll-up door 302 includes segments 306*a* to 306*e* such that facilitate the door 302 bending in order to move from a closed position, shown in FIG. 3B, to an open position, shown in FIG. 3C, and vice versa. Although the door 302 in the example shown includes five sections 306*a* to 306*e*, the door 302 may include any number of sections. For example, the door 302 may include a single section such that the door 302 does not bend when moving from the closed to open positions.

FIG. 3B shows cross-section view of the transport trailer 300 with the door 302 in a closed position, and FIG. 3C shows a cross-section view of the transport trailer 300 with the door 302 in an open position. The dots in FIGS. 3B and 3C merely indicate the joints between adjacent sections 306*a* to 306*e* of the door 302. As can be seen in the example shown in FIGS. 3B and 3C, the door 302 travels upward and backward into the transport trailer 300 to move from a substantially vertical closed position (FIG. 3B) to a substantially horizontal open position (FIG. 3C). The door 302 may move from the closed position to the open position along tracks (not shown).

In other examples the roll-up door 302 may move may any suitable way between the open and closed positions. For example, the door 302 may include a single section and may rotate from the substantially vertical closed position to the substantially horizontal open position without bending as shown in FIG. 3C.

As can be seen in FIGS. 3B and 3C, when the door 302 moves from the substantially vertical closed position to the substantially horizontal open position, the internal reference axis 308 of the device 304 also changes from substantially vertical in the closed position, as shown in FIG. 3B, to substantially horizontal in the open position, as shown in FIG. 3C, in the frame of reference of the transport trailer 300.

This rotation of the internal reference axis 308 of the device 304 presents a challenge for tamper detection compared to, for example, a device installed on a barn-type door. As described above, any changes to the orientation of the internal reference axis 308 of the device 304, e.g., any rotation about a horizontal axis as viewed in FIG. 3A, may be not be expected under normal operating conditions and therefore may be determined as a tampering event. However, when the device 304 is installed on a roll-up type door 302, the internal reference axis 308 of the device 304 does change orientation when the door 302 moves between the open and closed positions, in addition to rotations about the vertical axis as viewed in FIG. 3A when the transport trailer 300 changes its direction of travel.

Additionally, the orientation states of the device 304 that are measured by an orientation sensor (not shown) included in the device may depend upon the location of the device on the door 302. In the example shown, the internal reference axis 308 of the device 304 is substantially horizontal in the open position shown in FIG. 3C. However, if the device 304 was mounted to the door 302 at segment 306*e*, for example, the orientation of the internal reference axis 308 of the device would not be substantially horizontal in the example shown in FIG. 3C. Further, as described above, the orientation sensor utilized to measure the orientation states of the device 304 may be considered analogous to a multi-sided object with each side having an associated number, and the measured orientation state being the number associated with the side facing a reference direction, such as the direction of the force of gravity. Because the orientation of the orientation sensor within the device may differ from device to device, different orientation state measurements may be output for different devices despite the devices having the same orientation. This presents further challenges for tamper detection in such devices.

In the present disclosure, tamper detection is performed by first determining the expected orientation states of the device based on a plurality of orientation states measured by an orientation sensor of the device. The plurality of orientation states may be utilized to determine expected orientation states of the device under expected normal operation. In the example shown in FIGS. 3B and 3C, the expected orientation states may be the orientation states of device 304 when the door 302 is in the open and closed positions. In some examples, the expected positions may include more than two orientation states. For example, if the door 302 in the example shown in FIGS. 3A through 3C had an intermediately position between the opened and closed positions, the orientation state of the device 304 in this intermediary position may be an additional expected position. Once the expected orientation states are determined, subsequently measured orientation states may be compared to the expected orientation states and a tamper alert generated whenever the measured orientation state differs from, or is other than, the expected orientation states.

Although the example shown in FIGS. 3A through 3C describe a device mounted to a door, the present disclosure may be applied to a device mounted to other moveable objects.

Figure 4A:
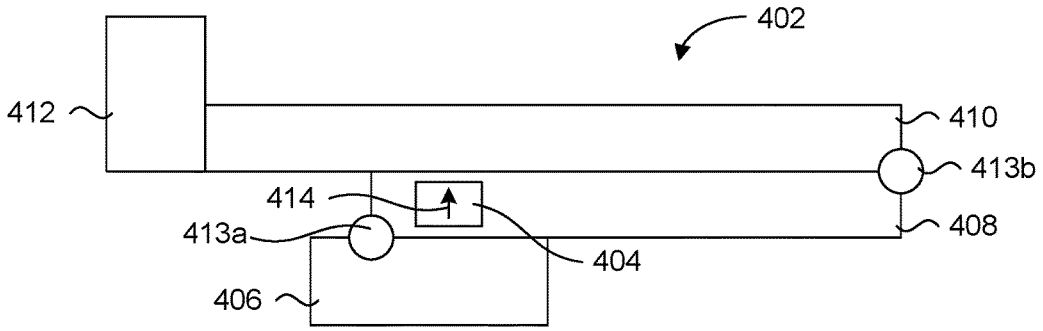
FIGS. 4A and 4B are side elevation views of an orientation sensing device attached to a crane arm in a lowered and closed position, respectively, in accordance with the present disclosure.
Figure 4B:
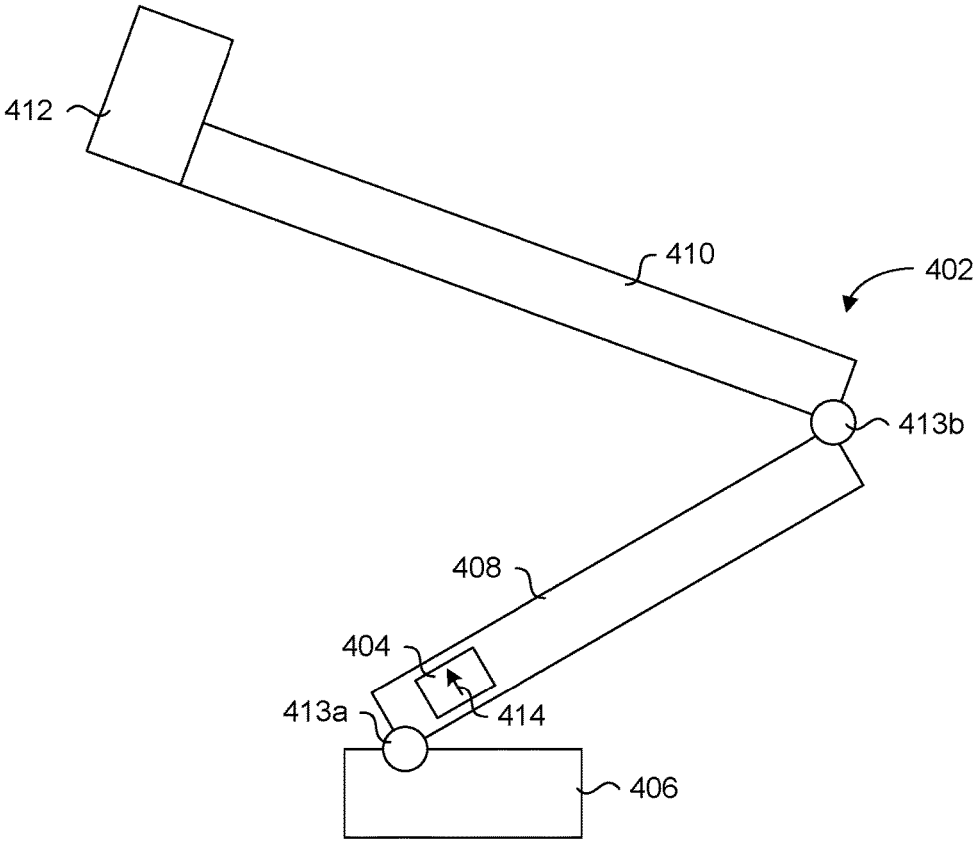

Referring to FIGS. 4A and 4B, another embodiment in which an orientation sensing device 404 is mounted onto a crane arm 402. The device 404 may be similar to the gateway 212 described above with reference to FIG. 2B. The example crane arm 402 is of a type that may hoist a worker, and may be referred to as a "cherry picker", however the device 404 may be mounted to other types of crane arms and tamper detection performed in a similar manner.

The example crane arm 402 includes a base 406, a lower arm 408, an upper arm 410, and a bucket 412 in which the worker would be located. The crane arm includes a first joint 213*a* between the base 406 and the lower arm 408 that enables rotational motion of the lower arm 408 with respect to the base 406. The crane arm 402 also includes a second joint 213*b* between the lower arm 408 and the upper arm 410 that enables rotation motion of the upper arm 410 with respect to the lower arm 408. The rotation motion of the lower arm 408 and the upper arm 410 may be seen in FIG. 4B. In the example, the device 404 is mounted to a side surface of the lower arm 408. However, the device 404 could also be mounted to, for example, a top or bottom surface of the lower arm 408, or any of the top, bottom, or side surfaces of the upper arm 410.

FIG. 4A shows the crane arm 402 in a lowered position and FIG. 4B shows the crane arm 402 in an extended position. As can be seen in FIGS. 4A and 4B, the orientation state of the device 402 changes when the crane arm 402 moves between the lowered and extended positions. For example, FIGS. 4A and 4B show that an internal reference axis 414 of the device 404 changes from a substantially vertical orientation in the lowered position, to an orientation is rotated from vertical.

The expected orientation states of the device 404 may be determined similar to the determination of the expected orientation states of the device 304 described above with reference to FIGS. 3A through 3C. For example a plurality of measured orientation states of the device 404 may be received, and the expected orientation states based on the received measured orientation states. The expected orientation states may correspond to the orientation states of the device 404 when the crane arm 402 is the lowered and extended positions. Further, the expected orientation states may also include the orientation states of the device 404 in any intermediate position of the crane arm 402.

Figure 5:
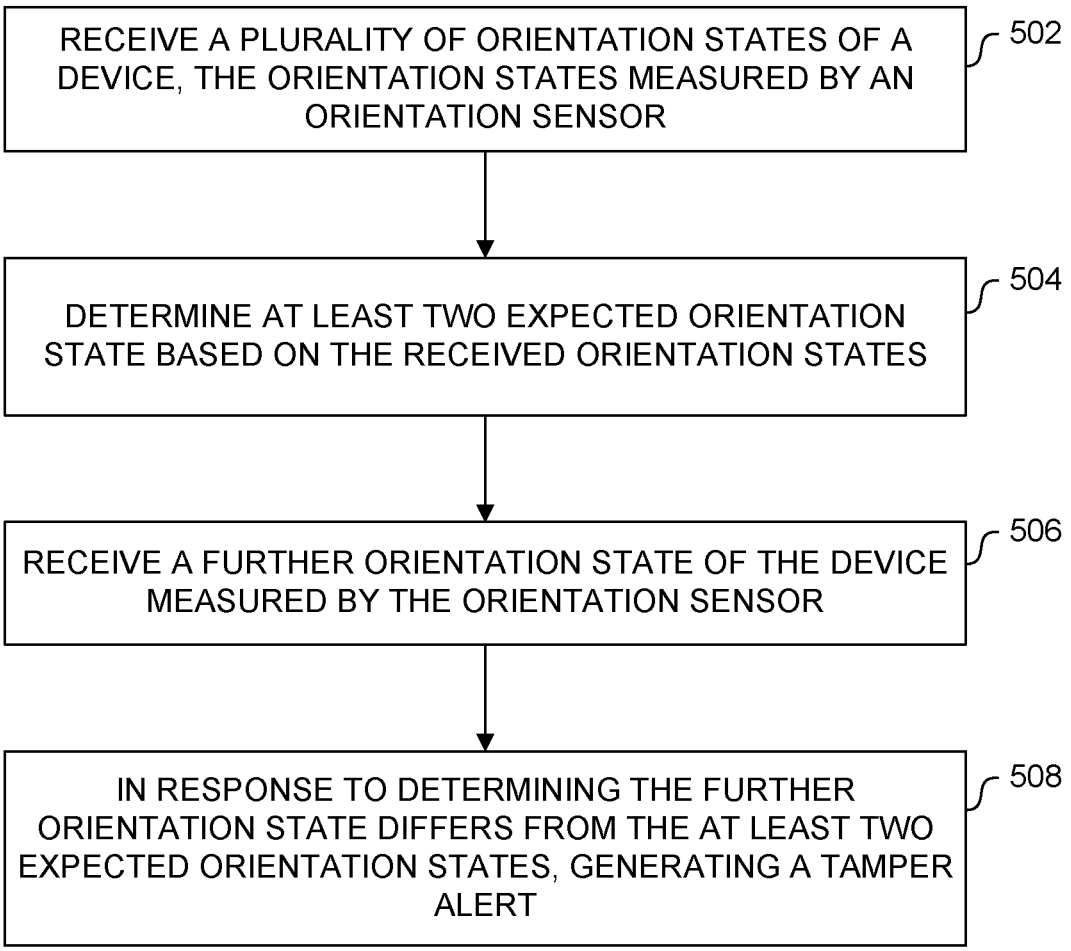
FIG. 5 is a flowchart illustrating a method for detecting tampering in a device mounted to a door in accordance with an embodiment of the present disclosure.

Referring now to FIG. 5, a flow chart illustrating an example method for detecting tampering of a device, such as a gateway, coupled to a moveable object is shown. The method may be carried out by software executed by a processor of a remote device in communication with the device. In an example, the method may be carried about by the remote device 106, or may be performed by the gateway 104, of the wireless node network 100 shown in FIG. 1. In some embodiments, a portion of the method may be performed by a processor of the device, such as processor of the gateway 104, and another portion of the method may be performed by a processor of a remote device, such as the remote device 106. Coding of software for carrying out such a method is within the scope of a person of ordinary skill in the art given the present description. The method may contain additional or fewer processes than shown and/or described, and may be performed in a different order. Computer-readable code executable by at least one processor to perform the method may be stored in a computer-readable storage medium, such as a non-transitory computer-readable medium. The computer-readable code may be incorporated into an operating system or may be incorporated into a stand-alone application.

At 502, a plurality of orientation states of a device mounted on a moveable object are received. The orientation states are measured by an orientation sensor of the device, such as orientation sensor 212 describe previously. In the case in which the method is performed by a remote device, the plurality of orientation states may be received at the remote device in communication with the device. For example, the device may include a communication subsystem, similar to communication subsystem 222 of the gateway 212 described previously, which transmits the orientation sensor measurements to the remote device via a network, such as network 108.

Alternatively, in the case in which the method is performed at the device, the plurality of orientation states may be received by a processor of the device, such as, for example, the processor 214 of the device 212. The orientation states measured by the orientation sensor may be stored in a memory such that the plurality of orientation states may be received at the processor of the device from the memory.

At 504, at least two expected orientation states are determined based on the received plurality of orientation states received at 502. In an example, the at least two expected orientation states state may be determined as the at least two most common orientation states of the plurality of orientation states. The number of expected orientation states may be predetermined and may depend on the moveable object on which the device is mounted.

In the above-described example of the device 304 mounted to a roll-up door 302, the number of expected orientation states may be two, corresponding to a door-open orientation state and a door closed orientation state. Similarly, for the example of the device 404 mounted on a crane arm 402, the number of expected orientation states may be two, corresponding to the lowered orientation stated when the lower arm 408 is the lowered position and an extended orientation state when the lower arm 408 is in the extended position. For example, if the received orientation states are: [6, 4, 6, 4, 6, 3], then the orientation states [6] and [4] are the most common and are determined to be the door-open and door-closed orientation states for device 304, or the lowered and extended orientation states for the device 404.

The door 304 or crane arm 402 moves between positions fairly quickly, or near instantaneously in the case of a roll-up door 304. However, in order to avoid measuring orientation states while the door 304 or crane arm 402 is transitioning between positions, the device 304, 404 may, for example, be configured to wait before measuring the orientation state. The waiting may be, for example, to wait for movement to stop before measuring the orientation state, or may be to wait a predetermined time period after, for example, the detected movement that triggers the measuring of the orientation state. The predetermined time period may be determined as a time that is sufficient for the door 304 or crane 404 to transition between positions.

In an example, the determination at 504 may be performed in response to determining that a predetermined number of orientation states are received in order to ensure that the determination is made based on a sufficient sample size. For example, the determination at 504 may be made only after at least five measurements of the orientation states are received. In the above example, the number of received orientation states is six, and therefore the predetermined number of at least five orientation states is met.

Alternatively, or additionally, the determination at 504 may be made in response to each of the at least two most common states meeting a threshold number. For example, in order to determine at 504 the door-open and door-closed orientation states for the example device 304, or the lowered and extended orientation states for the device 404, in the above described examples, the threshold may be two such that two most common orientation states must each have a count of at least two in order for the determination at 504 to be made. In the above example, the orientation state 6 has a count of three, and the orientation state 4 has a count of two, and therefore both of the two most common orientation states meet the threshold of two in this example. In another example, the determination at 504 may be made in response to the total number of received orientation states meeting a threshold number. For example, the threshold number may be five such that the expected orientation states are determined only when at least five measured orientation states are received.

In an example, the determination at 504 may be based on a subset of the plurality of orientation states received at 502.

For example, the determination at 504 may be based on the most recently measured orientation states such as, for example, the ten most-recent orientation states. In this way, the determination of the at least two expected orientation states may change over time to account for, for example, slight changes in the movements of the device over time.

In an alternative embodiment, the plurality of orientation states that are received at 502 may be generated during a calibration process. For example, the orientation sensor may measure the orientation state while the moveable objection is in various expected positions. For example, for the device 304 mounted on the door 302 described with reference to FIGS. 3A through 3C, the door 302 may be placed in each of the open and closed positions and the corresponding orientation states of the device 304 measured in each position. In this example, the plurality of orientation states received at 502 may be two orientation states that correspond to the door-open and door-closed orientation states, and the determination at 504 may be performed by setting the two received orientation states as the expected orientation states.

Similarly, for the example device 404 described above with reference to FIGS. 4A and 4B, the lower arm 408 may be placed in each of the lowered and extended positions and the corresponding orientation states of the device 404 measured in each position. In this example, the plurality of received orientation states received at 502 may be the two orientation states that correspond to the lowered and extended orientation states of the device 404, and the determination at 504 may be performed by setting the two received orientation states as the expected orientation states.

In general, the calibration process may include moving the moveable object through any number of expected positions, and measuring corresponding expected orientation states, which are then received as the plurality of orientation states at 502.

At 506, a subsequent orientation state is received. Similar to the plurality of orientation states received at 502, the subsequent orientation state received at 506 may be received at a remote device in communication with the device, or may be received at a processor of the device itself.

At 508, a tamper alert is generated in response to determining that the further orientation state received at 506 differs from the at least two expected orientation states determined at 504. The tamper alert may be generated at the remote device that receives the orientation state measurements, and/or may be generated at the device itself. In an example, the tamper alert may be transmitted to another device. The tamper alert may be any indication that the device has been tampered with and may be, for example, any audio or visual alert at the device or at a remote device or some combination of alerts at the device and the remote device. For example, the tamper alert may be one or more of an alert displayed on a display screen of a remote device that is utilized to monitor the device. The displayed alert may include, for example, a time and a location of the device when the tampering was detected. The location of the device may displayed as a map that includes an indication of the location of the device. Additionally, or alternatively, the alert may be an audio alert, such as an alarm or some other sound, output by a speaker. For example, the audio alert may be output by a speaker at the device to, for example, deter theft of the device. Alternatively, or additionally, the audio alert may be output by a speaker at a remote device that is monitoring the device to, for example, attract the attention of an operator of the remote device.

Embodiments of the present disclosure provide determining tampering at a device that is installed on a moveable surface such as, for example, a roll-up door. The present disclosure enables distinguishing between movement of the device that is expected, and unexpected movement that may indicate that the device has been tampered with, or that the vehicle on which the device is mounted has rolled over. By generating an alert in response to determining that the device has possibly been tampered with, tampering events may be identified and remedial action taken more quickly compared to determining tampering through periodic manual inspection. Further, in the case in which the tampering event is triggered by an accident of the vehicle, assistance of the driver and securing any potential harmful contents within the vehicle may be provided in a timely and automated way.

In the preceding description, for purposes of explanation, numerous details are set forth in order to provide a thorough understanding of the embodiments. However, it will be apparent to one skilled in the art that these specific details are not required. In other instances, well-known electrical structures and circuits are shown in block diagram form in order not to obscure the understanding. For example, specific details are not provided as to whether the embodiments described herein are implemented as a software routine, hardware circuit, firmware, or a combination thereof.

Embodiments of the disclosure can be represented as a computer program product stored in a machine-readable medium (also referred to as a computer-readable medium, a processor-readable medium, or a computer usable medium having a computer-readable program code embodied therein). The machine-readable medium can be any suitable tangible, non-transitory medium, including magnetic, optical, or electrical storage medium including a diskette, compact disk read only memory (CD-ROM), memory device (volatile or non-volatile), or similar storage mechanism. The machine-readable medium can contain various sets of instructions, code sequences, configuration information, or other data, which, when executed, cause a processor to perform steps in a method according to an embodiment of the disclosure. Those of ordinary skill in the art will appreciate that other instructions and operations necessary to implement the described implementations can also be stored on the machine-readable medium. The instructions stored on the machine-readable medium can be executed by a processor or other suitable processing device, and can interface with circuitry to perform the described tasks.

The above-described embodiments are intended to be examples only. Alterations, modifications and variations can be effected to the particular embodiments by those of skill in the art without departing from the scope, which is defined solely by the claims appended hereto.

What is claimed is:

1. A method for determining tampering at a device coupled to a moveable object comprising:

receiving a plurality of orientation states of the device, the plurality of orientation states measured by an orientation sensor;

determining, based on the received orientation states, at least two expected orientation states;

receiving a further orientation state of the device measured by the orientation sensor;

in response to determining that the further orientation state differs from the at least two expected orientation states, generating a tamper alert.

2. The method according to claim 1, wherein the moveable object is a roll-up door, and the at least two expected orientation states are a door-open orientation state and a door-closed orientation state corresponding to an open position and a closed position, respectively, of the roll-up door.

3. The method according to claim 1, wherein the moveable object is a crane arm, and the at least two expected orientation states are a lowered orientation state and an extended orientation state corresponding to a lower position and an extended position, respectively, of the crane arm.

4. The method according to claim 1, wherein determining the at least two expected orientation states comprises determining the at least two most common orientation states from the received plurality of orientation states.

5. The method according to claim 4, wherein determining the at least two expected orientation states further comprises determining that each of the at least two most common orientation states meets a threshold number.

6. The method according to claim 4, wherein determining the at least two expected orientation states is performed in response to the number of the received plurality of orientation states being at least a predetermined number.

7. The method according to claim 1, wherein the received plurality of orientation states are generated during a calibration process in which the orientation sensor measures, at least, a first expected orientation state when the moveable objection is in a first expected position and a second expected orientation state when the moveable object is in a second expected position, and wherein determining the at least two expected orientation states comprise setting the at least first expected orientation state and the second expected orientation state as the at least two expected orientation states.

8. The method according to claim 1, wherein the orientation state of the device is received in response to movement of the movable object.

9. The method according to claim 8, wherein movement of the moveable object is movement that meets a threshold amount.

10. An apparatus for determining tampering at a device coupled to a moveable object comprising:

a processor in communication with an orientation sensor of the device, the processor configured to:

receive a plurality of orientation states of the device, the plurality of orientation states measured by an orientation sensor;

determine, based on the received orientation states, at least two expected orientation states;

receive a further orientation state of the device measured by the orientation sensor;

in response to determining that the further orientation state differs from the at least two expected orientation states, generate a tamper alert.

11. The apparatus according to claim 10, wherein the device is coupled to a door, and the at least two expected orientation states are a door-open orientation state and a door-closed orientation state corresponding to an open position and a closed position, respectively, of the roll-up door.

12. The apparatus according to claim 10, wherein the moveable object is a crane arm, and the at least two expected orientation states are a lowered orientation state and an extended orientation state corresponding to a lower position and an extended position, respectively, of the crane arm.

13. The apparatus according to claim 10, wherein the processor is configured to determine at least two expected orientation states by determining the at least two most common orientation states from the received plurality of orientation states.

14. The apparatus according to claim 10, wherein the processor is configured to determine at least two expected orientation states when each of the two most common orientation states meets a threshold number.

15. The apparatus according to claim 10, wherein the processor is configured to determine at least two expected orientation states in response to the number of the received plurality of orientation states being at least a predetermined number of orientation states.

16. The apparatus according to claim 10, wherein the received plurality of orientation states are generated during a calibration process in which the orientation sensor measures, at least, a first expected orientation state when the moveable objection is in a first expected position and a second expected orientation state when the moveable object is in a second expected position, and wherein determining the at least two expected orientation states comprise setting the at least first expected orientation state and the second expected orientation state as the at least two expected orientation states.

17. The apparatus according to claim 10, wherein the orientation state of the device is received in response to movement of the moveable object.

18. The apparatus according to claim 17, wherein movement of the moveable object is movement that meets a threshold amount.

19. The apparatus according to claim 10, wherein the apparatus is a server in communication with the device.

* * * * *